US010415888B2

(12) United States Patent
Cachon et al.

(10) Patent No.: US 10,415,888 B2
(45) Date of Patent: Sep. 17, 2019

(54) HEAT EXCHANGER FOR EXCHANGING HEAT BETWEEN TWO FLUIDS, USE OF THE EXCHANGER WITH LIQUID METAL AND GAS, APPLICATION TO A FAST NEUTRON NUCLEAR REACTOR COOLED WITH LIQUID METAL

(71) Applicant: COMMISSARIAT A L'ENERGIE ATOMIQUE ET AUX ENERGIES ALTERNATIVES, Paris (FR)

(72) Inventors: Lionel Cachon, Manosque (FR); Christophe Garnier, Vinon sur Verdon (FR); Alexandre Molla, Venelles (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 539 days.

(21) Appl. No.: 14/914,362

(22) PCT Filed: Aug. 22, 2014

(86) PCT No.: PCT/IB2014/064023
§ 371 (c)(1),
(2) Date: Feb. 25, 2016

(87) PCT Pub. No.: WO2015/028923
PCT Pub. Date: Mar. 5, 2015

(65) Prior Publication Data

US 2016/0201999 A1 Jul. 14, 2016

(30) Foreign Application Priority Data

Aug. 26, 2013 (FR) ..... 13 58178

(51) Int. Cl.
*F28F 9/02* (2006.01)
*F28D 9/00* (2006.01)
(Continued)

(52) U.S. Cl.
CPC ..... *F28D 7/0083* (2013.01); *F28D 9/0006* (2013.01); *F28D 9/0093* (2013.01);
(Continued)

(58) Field of Classification Search
CPC .... F28D 7/0083; F28D 9/0006; F28D 9/0093; F28F 9/0075; F28F 9/027; F28F 9/0275; F28F 9/26
(Continued)

(56) References Cited

U.S. PATENT DOCUMENTS 5,755,280 A 5/1998 da Costa et al.
8,081,729 B2 12/2011 Cros
(Continued)

FOREIGN PATENT DOCUMENTS

FR 2733823 A1 11/1996
FR 2887618 A1 12/2006

OTHER PUBLICATIONS

Innovative Power Converstion System for the French SFR Prototype, ASTRID, L.Cachon et al., ICAPP '12, Chicago Jun. 24-28, 2012.

(Continued)

*Primary Examiner* — Joel M Attey
(74) *Attorney, Agent, or Firm* — Cooper Legal Group, LLC; Ronald M. Kachmarik

(57) ABSTRACT

A heat exchanger for exchanging heat between two fluids, use of the exchanger with liquid metal and gas, and application to a fast neutron nuclear reactor cooled with liquid metal. The present invention concerns a heat exchanger (1) for exchanging heat between a first fluid ($N_2$) and a second fluid (Na). According to the invention, the structure of the heat exchanger makes it possible to supply and recover the primary fluid, such as sodium (Na), to and from a given longitudinal end (2*a*) opposite the longitudinal end (2*b*) by
(Continued)

which the secondary fluid, such as nitrogen ($N_2$), is supplied and recovered. This allows a physical separation between the paths of the two fluids in the exchanger, with the possibility, in particular, of having restricted access for one of the fluids, such as sodium (Na) and non-restricted access for the other of the fluids, such as nitrogen ($N_2$).

17 Claims, 8 Drawing Sheets

(51) Int. Cl.

| | |
|---|---|
| ***F28F 9/007*** | (2006.01) |
| ***F28F 9/26*** | (2006.01) |
| ***F28D 7/00*** | (2006.01) |
| *F28D 21/00* | (2006.01) |

(52) U.S. Cl.
CPC ..... *F28F 9/0075* (2013.01); *F28F 9/027* (2013.01); *F28F 9/0275* (2013.01); *F28F 9/26* (2013.01); *F28D 2021/0054* (2013.01)

(58) Field of Classification Search
USPC ..... 165/157, 159, 160, 162, 163
See application file for complete search history.

(56) References Cited

U.S. PATENT DOCUMENTS

| | | | | |
|---|---|---|---|---|
| 2007/0169924 | A1* | 7/2007 | Bussonnet | F28D 9/0006 165/157 |
| 2008/0292041 | A1 | 11/2008 | Kim et al. | |
| 2009/0050295 | A1 | 2/2009 | Francois | |
| 2010/0129283 | A1* | 5/2010 | Filippi | B01J 8/043 423/352 |
| 2011/0052457 | A1* | 3/2011 | Rizzi | B01J 8/0214 422/198 |
| 2013/0182812 | A1* | 7/2013 | Eckardt | B01D 53/04 376/283 |

OTHER PUBLICATIONS

International Search Report in PCT/IB2014/064023 dated Dec. 10, 2014.

* cited by examiner

X
Hot $N_2$
11
6
2a
$N_2$
10
Cold $N_2$
1
7
20
70
23
Na
3.3
3.4
23
$N_2$
3.2
2
3.1
71
23
21
40
$N_2$
5
84
98
91
93
82
13
12
Cold $N_a$
2b
Hot $N_a$
17
14
X

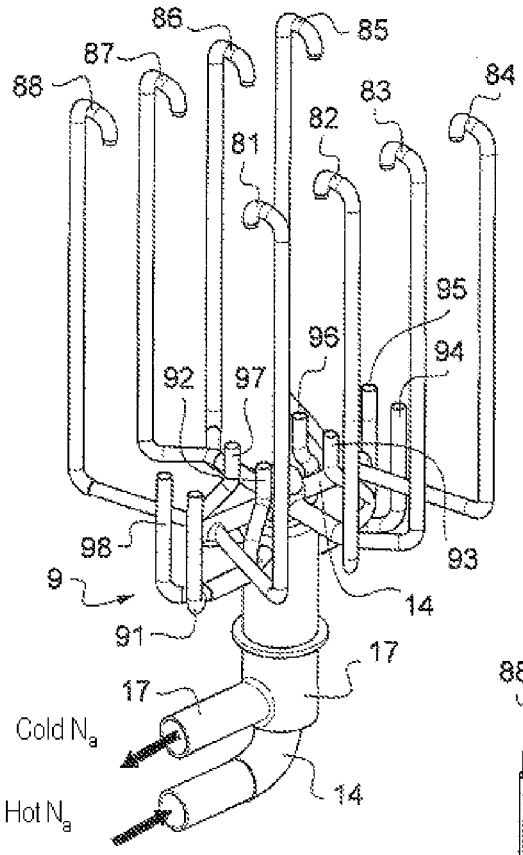
Fig.7A
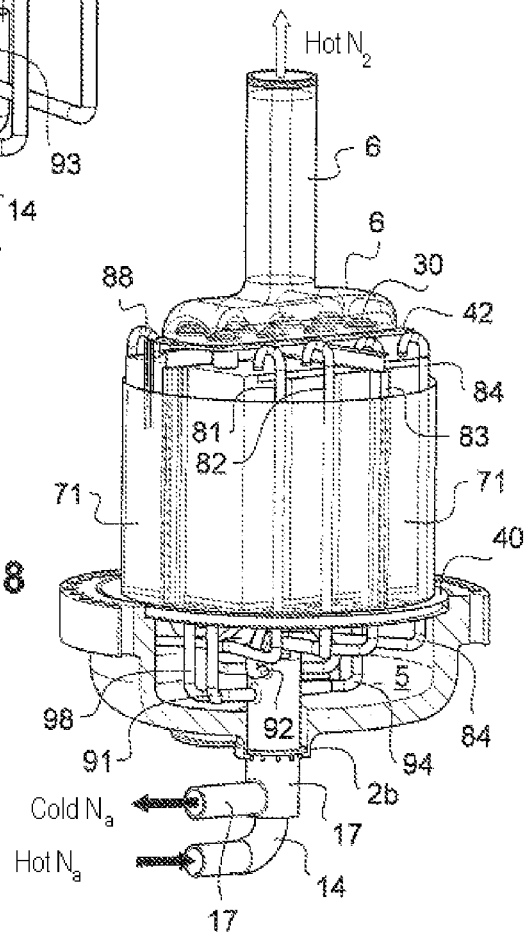
Fig.8
Fig.8A
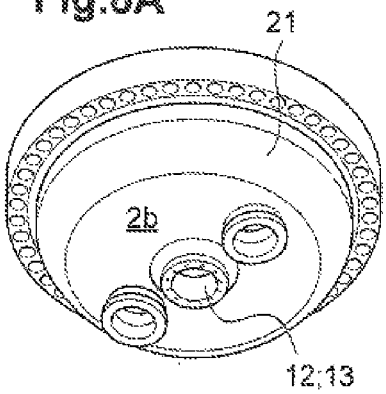

HEAT EXCHANGER FOR EXCHANGING HEAT BETWEEN TWO FLUIDS, USE OF THE EXCHANGER WITH LIQUID METAL AND GAS, APPLICATION TO A FAST NEUTRON NUCLEAR REACTOR COOLED WITH LIQUID METAL

TECHNICAL FIELD

The present invention relates to heat exchangers between two fluids.

The invention deals more particularly with the production of a new type of heat exchanger that is compact and of high thermal power.

The invention thus relates to a heat exchanger incorporating one or more exchanger modules of plate type in a calandria under pressure.

The main use of the exchanger between two fluids according to the invention is its use with liquid metal and gas. It can advantageously involve liquid sodium and nitrogen.

The main application targeted by the exchanger according to the invention is the exchange of heat between a liquid metal, such as liquid sodium, from the secondary loop and of nitrogen as gas from the tertiary loop of a fast neutron reactor cooled with liquid metal, such as with liquid sodium, called SFR (Sodium Fast Reactor) and which forms part of the family of so-called fourth generation reactors.

Although described in relation to this main application, a heat exchanger according to the invention can also be implemented in any other application requiring an exchange between two fluids, such as a liquid and a gas, preferably when it is necessary to have an exchanger that is compact and of high thermal power.

In the context of the invention, "primary fluid" should be understood to convey the usual meaning in thermal terms, namely the hot fluid which transfers its heat to the secondary fluid which is the cold fluid.

On the other hand, in the context of the invention, "secondary fluid" should be understood to convey the usual meaning in thermal terms, namely the cold fluid to which the heat is transferred from the primary fluid.

In the main application, the primary fluid is the sodium which circulates in the so-called secondary loop of the thermal conversion cycle of an SFR reactor, whereas the secondary fluid is the nitrogen which circulates in the tertiary loop of said cycle.

STATE OF THE ART

The existing so-called plate heat exchangers offer significant advantages over the existing so-called tube heat exchangers, particularly their thermal performance levels and their compactness by virtue of a favorably high ratio of the surface area to the heat exchange volume. The compact plate exchangers are used in numerous industrial fields.

The known tube exchangers are, for example, tube and calandria exchangers, in which a bundle of tubes that are straight or bent in the form of a U or in the form of a coil is fixed onto pierced plates and arranged inside a sealed enclosure called a calandria. In these tube and calandria exchangers, one of the fluids circulates inside tubes whereas the other fluid circulates inside the calandria. These tube and calandria exchangers exhibit a significant volume and are therefore not compact.

The literature already contains descriptions of the production of heat exchangers comprising compact plate exchanger modules arranged in a calandria under pressure.

The patent FR 2733823 can be cited here, which discloses the installation, in a calandria under pressure consisting of a sealed enclosure, of a bundle of plates with corrugations which allow said plates to operate at pressures higher than could be permitted by their intrinsic mechanical strength. The implementation of such an exchanger is highly dependent on the technology used to manufacture the bundle of corrugated plates and it is limited to a single bundle of plates, with the attendant drawback of limiting the unitary thermal power of the exchanger.

The compact plate exchangers are not currently implemented in the nuclear field and no nuclear engineering code incorporates them.

The company AREVA has, however, proposed, in the context of studies conducted on reactors with gases at high or very high temperatures, called HTR or VHTR ("High Temperature Reactor" or "Very High Temperature Reactor"), a solution for the design in a calandria of a series of plate exchanger modules by placing a part of the fluid supply and distribution manifolds in common. This solution, for example described in the patent FR 2887618, is advantageous in as much as the unitary thermal power of the exchanger can be increased by increasing the number of exchanger modules in series. On the other hand, the radial orientation of the exchanger modules and the relative arrangement of the manifolds in relation to the sealed enclosure forming the calandria, on the one hand limit the use of the exchanger to an exchange between gas and gas because, the draining of a liquid is not possible and, on the other hand do not make it possible to have a truly compact exchanger. Thus, the volume occupied by the structures (sealed enclosure, support, etc.) and the manifolds is very much greater than the intrinsic volume of the exchanger modules.

In addition to the issues of exchanger compactness and of high unitary thermal power, the inventors of the present invention were confronted with the need to find a heat exchanger between a liquid metal, such as liquid sodium, and a gas, with the need to be able to effect a gravity draining of the liquid metal circuit and therefore an elimination of the retention zones in this circuit.

In the context of their studies for a prototype liquid sodium-cooled fast neutron nuclear reactor, the inventors have already proposed a solution for the design of a heat exchanger between liquid sodium and a gas which implements compact plate exchanger modules. This solution is for example described in the publication [1].

FIGS. 1 to 1C reproduce the views of the heat exchanger as disclosed in this publication [1].

The heat exchanger 1 is intended to transfer heat between a first fluid, which is nitrogen ($N_2$) (cold fluid) and a second fluid which is the liquid sodium (Na).

Also indicated in these FIGS. 1 to 1C are the characteristic temperatures and pressures respectively of the nitrogen and of the sodium as provided as they enter and leave the exchanger 1. In particular, the pressure of 180 bar is that of the nitrogen and therefore that prevailing inside the sealed enclosure 2.

The heat exchanger 1 of central axis X comprises a sealed enclosure 2 in which is housed a plurality 3 of exchanger modules 3.1, 3.2, 3.3, 3.4, arranged vertically and parallel to the axis X. As better illustrated in FIG. 1A, the number of identical exchanger modules is equal to four.

The sealed enclosure 2 is of generally essentially cylindrical form and consists essentially of a cover 20 joined to a bottom 21. The cover 20 has no opening.

Thus, the sealed enclosure 2 comprises, at one 2*a* of its longitudinal ends, both an inlet 10 and an outlet 11 for the nitrogen and an inlet 12 and an outlet 13 for the liquid sodium.

Each exchanger module 3.1, 3.2, 3.3, 3.4 incorporates two fluid circuits, one dedicated to the circulation of the sodium (Na) originating from an SFR nuclear reactor, as primary fluid of the exchanger module, and the other dedicated to the circulation of the nitrogen ($N_2$) as secondary fluid.

The plurality 3 of exchanger modules 3.1, 3.2, 3.3, 3.4 is supported by a support structure 4.

As explained hereinbelow, the support structure 4 is fixed flexibly in the sealed enclosure 2. To this end, the exchanger modules 3.1, 3.2, 3.3, 3.4 are placed on an open-work support plate 40 which is suspended in the enclosure 2 via flexible arms 40*a*, 40*b*, 40*c* (FIG. 1C).

An inlet chamber 5 for the nitrogen is formed axially above the enclosure 2, at its upper longitudinal end 2*b*, between the exchanger modules 3.1 to 3.4 and the cover 20 of the enclosure 2.

As illustrated in FIG. 1 by the inward-pointing arrows, this chamber 5 communicates with each inlet, not represented, of the nitrogen circuit incorporated in one of the exchanger modules 3.1 to 3.4.

Opposite the chamber 5, a first central manifold 6 is arranged axially around the central axis (X). The function of this first central manifold 6 is to recover the hot nitrogen to which the heat has been transferred from the sodium in the exchanger modules 3.1 to 3.4.

This central manifold 6 therefore communicates upstream with each outlet, not represented, of the nitrogen circuit incorporated in one of the exchanger modules 3.1 to 3.4. Downstream, this central manifold 6 communicates with the outlet 11 for the nitrogen from the enclosure 2.

An annular manifold 7 is arranged around the central manifold 6 and the exchanger modules 3.1 to 3.4 forming a guiding space for the nitrogen. The function of this annular manifold 7 is to bring the cold nitrogen into the chamber 5.

More specifically, this annular manifold 7 essentially consists of a deflector of flared form 70 and a shell of cylindrical form 71. Thus, the guiding space for the nitrogen is delimited from upstream to downstream, outside, by the enclosure 2 and, inside, by the first central manifold 6 then by the deflector 70 and the shell 71. The annular manifold 7 is arranged coaxially around the first central manifold 6.

The annular manifold 7 therefore communicates upstream with the inlet 10 for the nitrogen from the enclosure 2 and downstream with the chamber 5.

A plurality 8 of inlet conduits 81, 82, 83, 84 is arranged to bring the hot sodium into each of the inlets, not represented, of the sodium circuit incorporated in one of the exchanger modules 3.1 to 3.4.

Thus, each inlet conduit 81 to 84 communicates upstream with the inlet 12 for the sodium of the enclosure 2, and downstream with each inlet 31 to 34 of the sodium circuit incorporated in one of the exchanger modules 3.1 to 3.4.

As better illustrated in FIG. 1A, each inlet 31 to 34 is produced on a lateral side of the underside of a module 3.1 to 3.4: the plurality 8 of inlet conduits 81 to 84 is therefore curved inward to be able to open into these lateral inlets 31 to 34.

A plurality 9 of outlet conduits 91, 92, 93, 94 is arranged to extract the cold sodium from each of the outlets of the sodium circuit incorporated in one of the exchanger modules 3.1 to 3.4.

Thus, each outlet conduit 91 to 94 communicates upstream with an outlet of the sodium circuit incorporated in one of the exchanger modules 3.1 to 3.4 and downstream with the outlet 13 for the sodium of the enclosure 2. The outlet 13 for the cold sodium is made laterally and toward the top of the enclosure 2.

As better illustrated in FIG. 1A, each sodium outlet is produced on a lateral side of the top of a module 3.1 to 3.4: the plurality 9 of outlet conduits 91 to 94 is therefore curved inward to be able to open into these lateral outlets.

Also, as better illustrated in FIG. 1A, the plurality 8 of inlet conduits 81 to 84 communicates with a second central manifold 14 which therefore brings the hot liquid sodium through the inlet 12 of the enclosure 2. The first central manifold 6 is coaxial to the second central manifold 14 and arranged between the annular manifold 7 and the second central manifold 14.

The operation of the heat exchanger 1 which has just been described will now be explained briefly in relation to the path of the nitrogen and of the sodium.

The cold nitrogen arrives, at a temperature of the order of 330° C. and at a pressure of the order of 180 bar, through the inlet 10 and then is brought by the annular manifold 7 to the top of the enclosure 2 and is redirected to the inlet chamber 5 by the cover 20, as illustrated by the lateral arrows rising then redescending in FIG. 1.

The nitrogen then circulates through the heat exchanger modules 3.1 to 3.4 in which the heat originating from the hot sodium is transferred to it.

The nitrogen that has become hot, at a temperature of the order of 515° C., emerges from the modules 3.1 to 3.4 and then is extracted from the enclosure through the outlet 11 via the first central manifold 6.

For its part, the hot sodium is brought, at a temperature of the order of 530° C., by the second central manifold 14 through the inlet 12 and then is distributed into each exchanger module 3.1 to 3.4 by the inlet conduits 81 to 84.

The hot sodium then passes through the heat exchanger modules 3.1 to 3.4 in which it transfers its heat to the nitrogen.

The sodium that has become cold, at a temperature of the order of 345° C., emerges from the modules 3.1 to 3.4 and then is extracted from the enclosure 2 through the outlet 13 via the outlet conduits 91 to 94.

The heat exchanger 1 which has just been described presents the advantages of being able to be of a high unitary thermal power and compact. Furthermore, the arrangement of the exchanger modules 3.1 to 3.4, of the plurality of inlet 8 and outlet 9 conduits and the second central manifold 14 allows for a gravity draining of the sodium but only of the hot sodium. Indeed, for the cold sodium, given the inward-curved form of the outlet conduits, it is highly probable that there is a retention of the cold sodium.

On the other hand, this heat exchanger presents the major drawback that the distribution of the fluids can prove difficult to guarantee on an industrial scale given the temperature levels required for the operation. Thus, in substance, it is first of all necessary to ensure the perfect sliding seal between the intake manifold 14 for the sodium and the outlet manifold 6 for the nitrogen which is coaxial, using a metal bellows 15. Moreover, the hot nitrogen which leaves the exchanger modules 3.1 to 3.4 is recovered by the deflector 70, as shown by the downward-curving arrows, which therefore thermally stresses the suspended support structure 4, 40 of the exchanger modules 3.1 to 3.4. The actual support part 40 must moreover produce the seal between the hot nitrogen present in the chamber 5 and the cold nitrogen recovered downstream. Thus, it is necessary to guarantee both the good mechanical and thermal strength of the flexibility of the arms 40*a* to 40*c* and a good flexibility at the level of the inlet conduits 81 to 84 for the sodium passing through the support 40 using metal bellows 16.

There is therefore a need to further improve the heat exchangers of the type comprising compact plate exchanger modules arranged in a calandria under pressure, notably with a view to giving them a high unitary thermal power and great compactness, while guaranteeing them industrial production.

The aim of the invention is to at least partially meet this need.

SUMMARY OF THE INVENTION

For this, the subject of the invention is a heat exchanger between a first and a second fluid, comprising:

- a sealed enclosure having a central axis and comprising, at one of its longitudinal ends, at least one inlet and one outlet for the first fluid and, at the other of its longitudinal ends, at least one inlet and one outlet for the second fluid, the sealed enclosure being adapted to be pressurized,
- at least one heat exchanger module incorporating a first and a second fluid circuit, extending parallel to the central axis and arranged inside the enclosure,
- a structure for supporting and holding the at least one exchanger module, rigidly fixed to the enclosure,
- an inlet or outlet chamber for the first fluid, formed axially between the support and the enclosure, and communicating with one of the inlet and the outlet of the first fluid circuit,
- a first central manifold extending around the central axis, arranged axially opposite the chamber and communicating, on the one hand, with one of the inlet and the outlet for the first fluid of the enclosure and, on the other hand, with the other of the inlet and the outlet of the first fluid circuit,
- an annular manifold arranged around the first central manifold and the at least one exchanger module at least to the support, forming a guiding space for the first fluid and communicating, on the one hand, with the other of the inlet and the outlet for the first fluid of the enclosure and, on the other hand, with the chamber,
- at least one inlet conduit communicating on the one hand with the inlet for the second fluid of the enclosure, and, on the other hand, with the inlet of the second fluid circuit,
- at least one outlet conduit communicating on the one hand with the outlet for the second fluid of the enclosure, and, on the other hand, with the outlet of the second fluid circuit, the conduits not being supported by the support and holding structure.

"Manifold" should be understood here and in the context of the invention to mean a device making it possible to distribute or collect a fluid, respectively to or from one or more channels.

"Conduit" should be understood here and in the context of the invention to mean a conduit making it possible to distribute or collect a fluid to or from a single channel.

"Conduits not being supported by the support and holding structure" should be understood here and in the context of the invention to mean that the function of the support structure is not to serve as a support for the conduits and that it does not receive any damaging mechanical force or thermal stress from the conduits. In other words, the conduits are arranged at a distance from the support and holding structure. To put it yet another way, the conduits and the support and holding structure are mechanically and thermally decoupled from one another.

In other words, the invention consists first of all essentially in defining a heat exchanger structure which makes it possible to supply and recover the primary fluid, such as the sodium, at a same longitudinal end and opposite the longitudinal end by which the secondary fluid, such as the nitrogen, is supplied and recovered. This makes it possible to have a physical separation between the paths of the two fluids in the exchanger with the possibility of having, notably, a regulated access for one of the fluids, such as the sodium, and an unregulated access for the other of the fluids, such as the nitrogen.

Thus, compared to the heat exchanger according to the publication [1] the sliding seal to be guaranteed between the manifold for recovering the hot nitrogen and the manifold for supplying the hot sodium is dispensed with.

Furthermore, the invention consists in rigidly fixing the support structure for the exchanger modules to the sealed enclosure and in supplying the coldest fluid (secondary fluid) on the side of the support. By virtue of that, the support structure is subjected to the relatively low temperatures, and therefore it is less thermally stressed.

In vertical operating configuration, the heat exchanger makes it possible to drain the primary fluid by gravity through the bottom of the sealed enclosure, opposite the first central manifold by which the secondary fluid, which is arranged in the top part of the sealed enclosure, is extracted.

Another advantage compared to the heat exchanger according to the publication [1], is that the flexibility of the support structure for the exchanger modules and the conduits is dispensed with.

To sum up, by virtue of the invention, a compact exchanger with high unitary thermal power is obtained for a liquid metal-gas exchange and for which the industrial production can be guaranteed easily and reliably.

According to an advantageous embodiment, the heat exchanger comprises:

- a plurality of heat exchanger modules, each extending parallel to the central axis (X) and each arranged inside the outer enclosure,
- a plurality of inlet conduits each communicating on the one hand with the inlet for the second fluid of the enclosure, and on the other hand with the inlet of the second fluid circuit of one of the exchanger modules,
- a plurality of outlet conduits communicating on the one hand with the outlet for the second fluid of the enclosure, and on the other hand with the outlet of the second fluid circuit. The unitary thermal power of such an exchanger is high.

Preferably, notably for reasons of compactness and fluid distribution, the plurality of inlet conduits communicates with a second central manifold.

Preferably, notably for reasons of compactness and fluid distribution, the plurality of outlet conduits communicates with a third central manifold.

According to an advantageous embodiment, the third central manifold is arranged coaxially around the second central manifold.

According to an advantageous variant, the inlet of the first and/or of the second fluid circuit of each exchanger module is arranged at a longitudinal end of each module.

According to an advantageous variant, the outlet of the first and/or of the second fluid circuit being arranged at a longitudinal end of each module.

Advantageously, the inlet of the first fluid circuit and the outlet of the second fluid circuit of each exchanger module being arranged at a same longitudinal end and the inlet of the second fluid circuit and the outlet of the first fluid circuit of each exchanger module being arranged at a same opposite longitudinal end.

The invention relates also, subject to another of its aspects, to a method of operating the heat exchanger which has just been described, the sealed enclosure being arranged substantially vertically with the inlet and the outlet for the first fluid at the top and the inlet and the outlet for the second fluid at the bottom.

The invention relates also to the use of the heat exchanger which has just been described, the first fluid, as secondary fluid, being a gas or a gas mixture, and the second fluid, as primary fluid, being a liquid metal.

According to an advantageous embodiment, the first fluid primarily comprises nitrogen and the second fluid being liquid sodium.

The first or the second fluid may originate from a nuclear reactor.

The invention relates finally to a nuclear installation comprising a fast neutron nuclear reactor cooled with liquid metal, notably liquid sodium, called RNR—Na or SFR, and a heat exchanger described previously.

DETAILED DESCRIPTION

Other advantages and features of the invention will emerge more on reading the detailed description of exemplary implementations of the invention given in an illustrative and nonlimiting manner with reference to the following figures in which.

Figure 9:
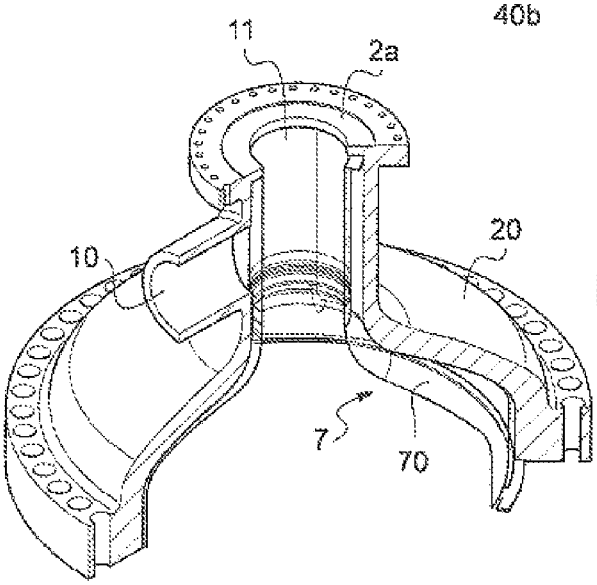
Figure 5:
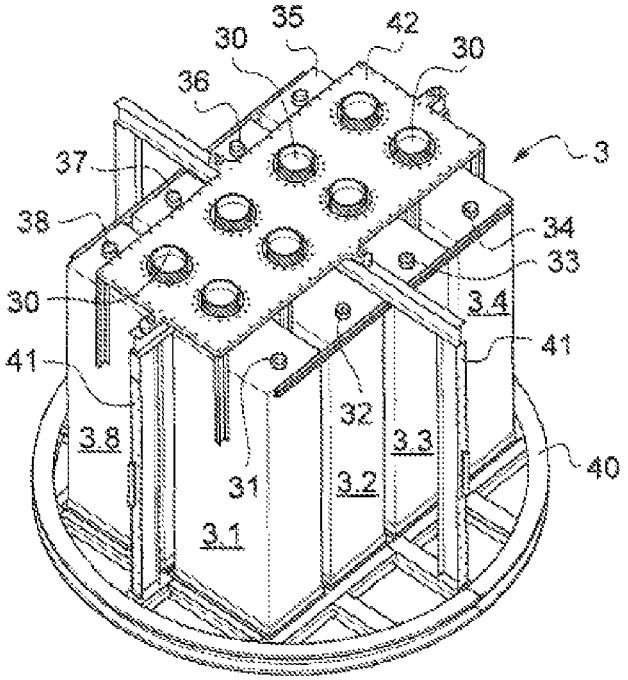
FIG. 5 is a perspective view of the plurality of exchanger modules and of another additional part of the support structure of the heat exchanger according to FIG. 2.
Figure 6:
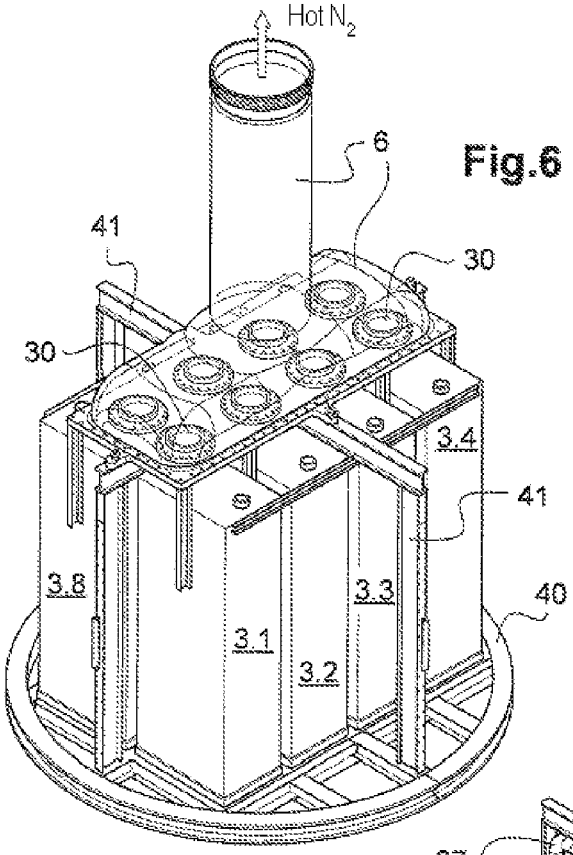
Figure 7:
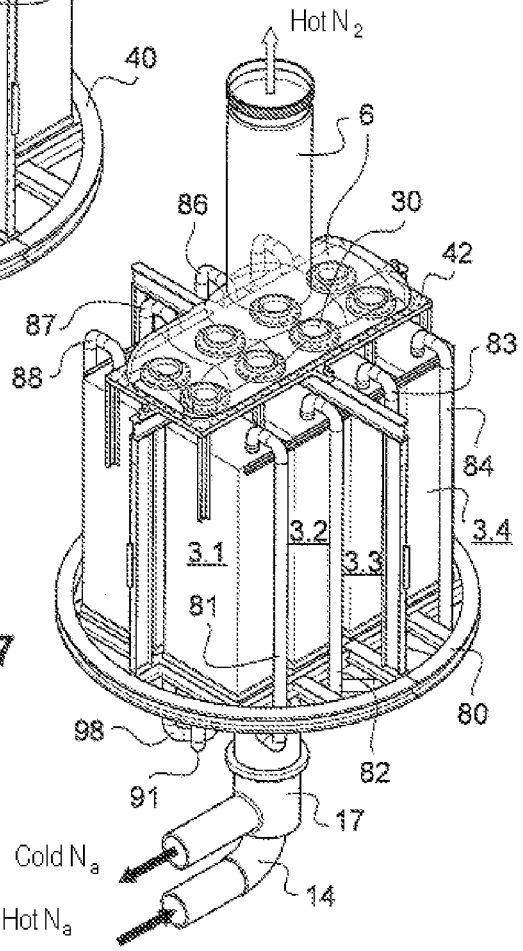

FIG. 6 reprises FIG. 5 and also illustrates, in perspective, the first central manifold of the heat exchanger according to the invention;

FIG. 7 reprises FIG. 6 and also illustrates, in perspective, the inlet and outlet conduits for one of the fluids and their central manifolds of the heat exchanger according to the invention;

FIG. 8 is an isolated perspective view of the inlet and outlet conduits for one of the fluids and of their central manifolds shown in FIG. 7;

FIG. 8A reprises FIG. 7 and also illustrates, in perspective, the arrangement of a part of the annular manifold and the arrangement of the inlet and outlet conduits and of their central manifolds in the bottom of the sealed enclosure of the exchanger according to the invention;

FIG. 9 is a perspective and cut-away view of the relative arrangement between the cover of the sealed enclosure and another part of the annular manifold.

Throughout the present application, the terms "vertical", "lower", "upper", "bottom", "top", "below" and "above" should be understood by reference relative to a heat exchanger according to the invention with its sealed enclosure as it is in vertical operating configuration. Thus, in an operating configuration, the central axis X of the sealed enclosure 2 is vertical and the cover 20 is at the top.

Similarly, throughout the present application, the terms "inlet", "outlet", "downstream" and "upstream" should be understood with reference to the direction of circulation of one or other of the two fluids through the heat exchanger according to the invention.

In the interests of clarity, the same references denote the same elements both for a heat exchanger 1 according to the prior art already described with reference to FIGS. 1 to 1C, and for a heat exchanger 1 according to the invention described with reference to FIGS. 2 to 9.

Figure 1:
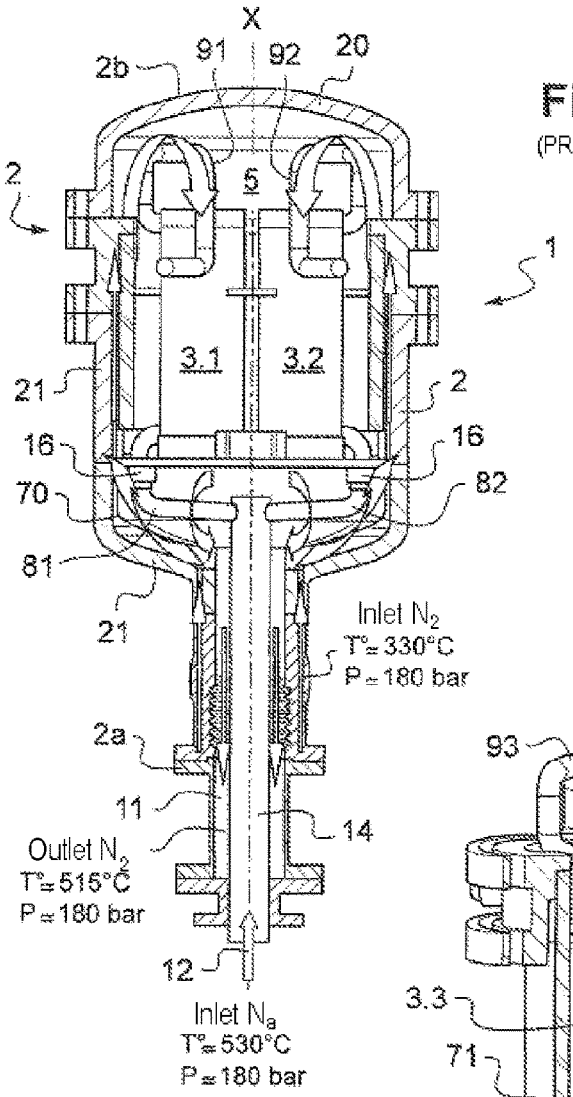
Fig.1 (PRIOR ART)
FIG. 1 is a view in longitudinal cross section and in perspective of a heat exchanger according to the prior art.
Figure 1A:
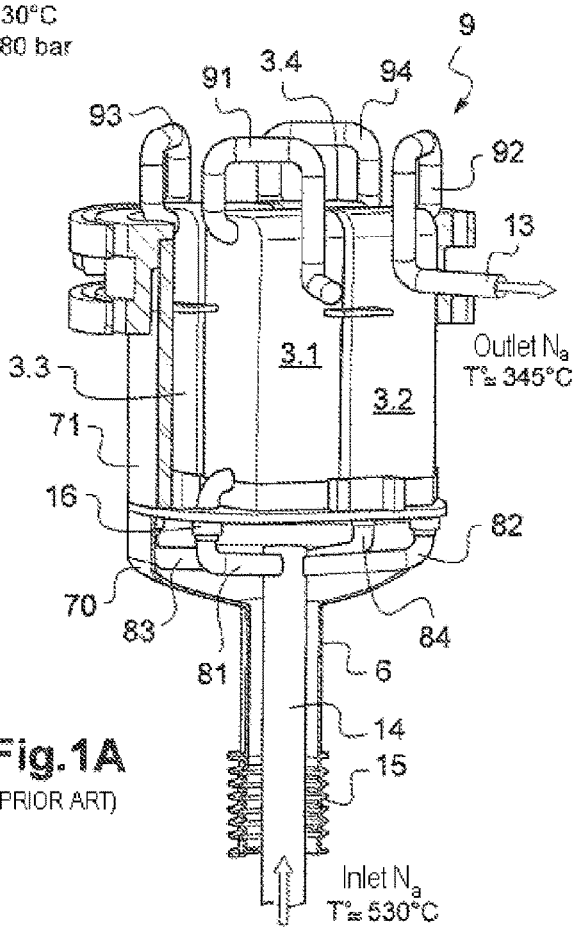
Fig.1A (PRIOR ART)
FIG. 1A is a perspective and cut-away view of the heat exchanger according to FIG. 1.
Figure 1B:
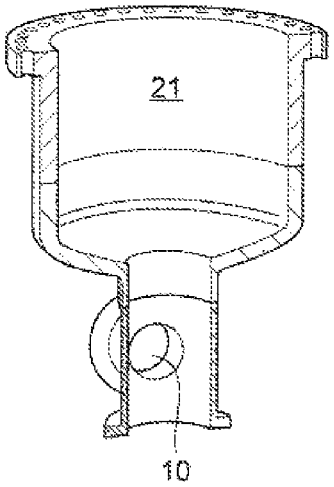
Fig.1B (PRIOR ART)
FIGS. 1B and 1C are detail views of the heat exchanger according to FIG. 1.
Figure 1C:
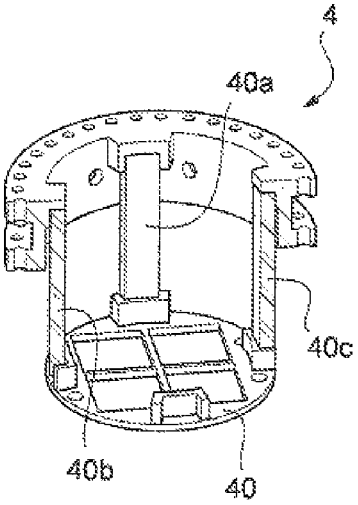
Fig.1C (PRIOR ART)

FIGS. 1 to 1C of the heat exchanger 1 according to the prior art, as disclosed in the publication [1], have already been commented on in the preamble. They are therefore not detailed hereinbelow.

The inventors of the present invention have sought to retain the advantages of the heat exchanger 1 according to this publication [1], namely, essentially, a good compactness and a high unitary thermal power, while dispensing with its major drawback. Thereby, they'll have sought to guarantee the distribution of the fluids in an industrial manner.

Thus, they have proposed the heat exchanger 1 illustrated in FIGS. 2 to 9, which is intended to transfer heat between a first fluid, which is nitrogen ($N_2$) (cold fluid) and a second fluid which is the liquid sodium (Na).

The heat exchanger 1 is represented in its vertical operating configuration with the cover 20 of the sealed enclosure on the top.

The heat exchanger 1 of central axis X comprises a sealed enclosure 2 in which is housed a plurality 3 of exchanger modules 3.1, 3.2, 3.3, 3.4, 3.5, 3.6, 3.7, 3.8 arranged vertically and parallel to the axis X. In the embodiment illustrated in FIGS. 2 to 10, the number of identical exchanger modules is equal to eight.

The sealed enclosure 2 is of essentially cylindrical general form and consists essentially of a cover 20, a bottom 21 and a lateral jacket 22 in the form of a shell. The cover 20 and the shell 22 are joined together by means of a first group of bolts 23. The bottom 21 and the shell 22 are also joined together by means of a second group of bolts 23.

The sealed enclosure 2 comprises, at one 2*a* of its longitudinal ends, an inlet 10 and an outlet 11 for the nitrogen.

At the other 2*b* of the longitudinal ends of the enclosure 2, there are provided an inlet 12 and an outlet 13 for the liquid sodium.

Each exchanger module 3.1 to 3.8 incorporates two fluid circuits, one dedicated to the circulation of the sodium (Na) originating from a nuclear reactor SFR, as primary fluid for the exchanger module, and the other dedicated to the circulation of the nitrogen ($N_2$) as secondary fluid.

The plurality 3 of exchanger modules 3.1 to 3.8 is supported by a support and holding structure 4. The support and holding structure 4 is thus rigidly fixed to the outer enclosure 2.

An inlet chamber 5 for the nitrogen is formed axially on the underside of the enclosure 2, at its lower longitudinal end 2*b*, between the support structure 4 and the bottom 21 of the enclosure 2. In other words, this chamber 5 is the space available between the support structure 4 and the bottom 21 of the enclosure 2.

This chamber 5 communicates with each inlet, not represented, of the nitrogen circuit incorporated in one of the exchanger modules 3.1 to 3.8.

Opposite the chamber 5, a first central manifold 6 is arranged axially around the central axis (X). The function of this first central manifold 6 is to recover the hot nitrogen to which the heat has been transferred from the sodium in the exchanger modules 3.1 to 3.8. This hot manifold 6 is thus common to the modules 3.1 to 3.8 but each independently feeds this manifold by the outlet 30.

This central manifold 6 therefore communicates upstream with each outlet 30 of the nitrogen circuit incorporated in one of the exchanger modules 3.1 to 3.4. Downstream, this central manifold communicates with the outlet 11 for the nitrogen of the enclosure 2, i.e. through the cover 20.

An annular manifold 7 is arranged coaxially around the central manifold 6 and the exchanger modules 3.1 to 3.8, forming a guiding space for the nitrogen. The function of this annular manifold 7 is to bring the cold nitrogen into the chamber 5.

More specifically, this annular manifold 7 consists essentially of a deflector of flared form 70 and a shell of cylindrical form 71. The annular manifold 7 may consist of a single piece produced by sheet metalwork.

A relative arrangement between the deflector 70 and the cover 20 of the enclosure is shown in FIG. 9.

The guiding space 72 for the cold nitrogen originating from the inlet 10 is delimited from upstream to downstream, outside by the enclosure 2 and inside only by the annular manifold 7, that is to say by the deflector 70 and the shell 71. Thus, the function of the shell 71 is to guide the cold nitrogen along the wall of the sealed enclosure 2, in order to distribute by the bottom ends of the modules 3.1 to 3.8. In other words, the cold nitrogen distributed in the annular space 72 sets the temperature of the wall of the sealed enclosure 2, typically at approximately 330° C.

The annular manifold 7 therefore communicates upstream with the inlet 10 for the nitrogen of the enclosure 2 and downstream with the chamber 5.

A plurality 8 of inlet conduits 81, 82, 83, 84, 85, 86, 87, 88 is arranged to bring the hot sodium into each of the inlets 31, 32, 33, 34, 35, 36, 37, 38 of the sodium circuit incorporated in one of the exchanger modules 3.1 to 3.8.

Thus, each inlet conduit 81 to 88 communicates upstream with the inlet 12 for the sodium of the enclosure 2, and downstream with each inlet 31 to 38 of the sodium circuit incorporated in one of the exchanger modules 3.1 to 3.8. Advantageously, the plurality 8 of inlet conduits communicates with a second central manifold 14.

Figure 2:
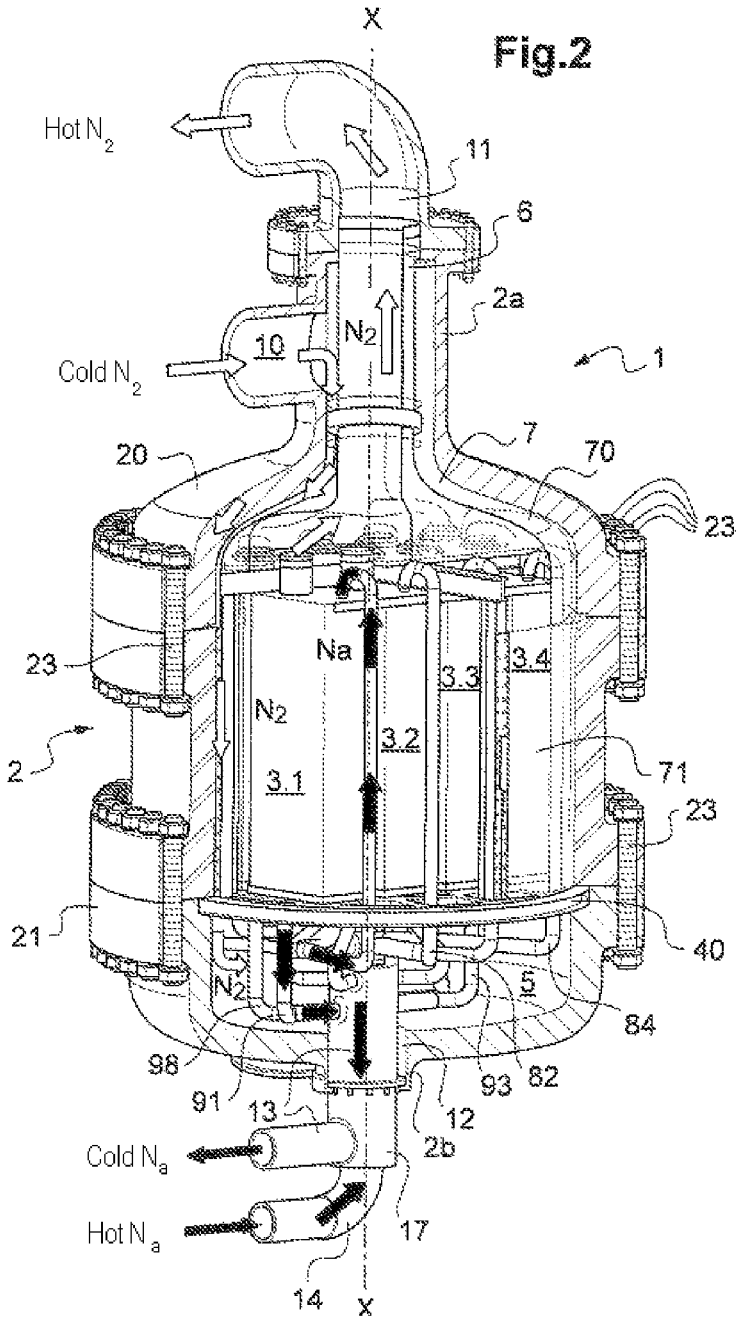
FIG. 2 is a perspective and cut-away view of a heat exchanger according to the invention.

As better illustrated in FIG. 2, each inlet 31 to 38 is produced on the top of a module 3.1 to 3.8: the plurality 8 of inlet conduits 81 to 88 is therefore curved inward to be able to emerge into these longitudinal inlets 31 to 38.

As a variant not represented, provision can be made for each inlet 31 to 38 to be produced on a longitudinal side in the top part of a module 3.1 to 3.8. A plurality 9 of outlet conduits 91, 92, 93, 94, 95, 96, 7, 98 is arranged to extract the cold sodium from each of the outlets of the sodium circuit incorporated in one of the exchanger modules 3.1 to 3.8.

Thus, each outlet conduit 91 to 98 communicates upstream with an outlet of the sodium circuit incorporated in one of the exchanger modules 3.1 to 3.8 and downstream with the outlet 13 for the sodium of the enclosure 2. The outlet 13 for the cold sodium is made toward the bottom of the enclosure 2 through the bottom 21. Advantageously, the plurality 9 of outlet conduits communicates with a third central manifold 17.

An exemplary advantageous embodiment of the plurality of inlet 8 and outlet 9 conduits and their relative arrangement is shown in FIG. 7A: the coaxial arrangement of the third central manifold 17 around the second central manifold 14 can be seen clearly.

Figure 3:
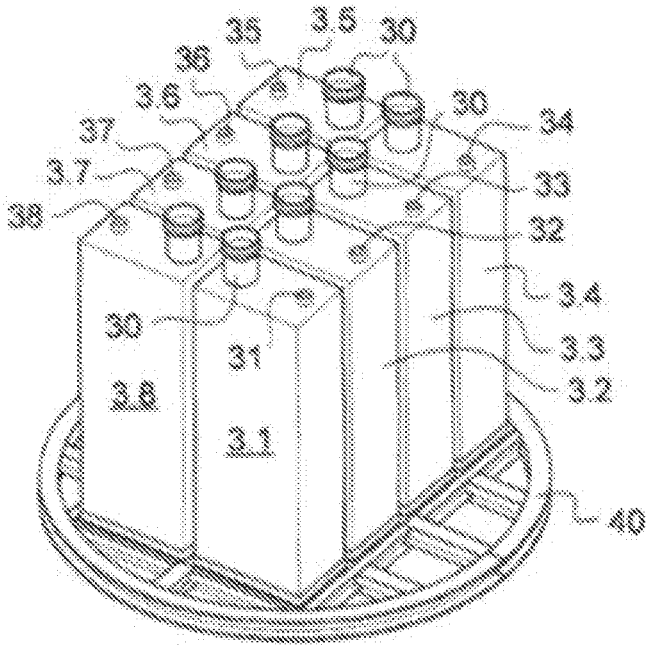
FIG. 3 is a perspective view of the plurality of exchanger modules and of a part of the support structure of the heat exchanger according to FIG. 2.

As better illustrated in FIG. 3, the support and holding structure 4 comprises a support platform 40 which bears against a peripheral shoulder inside the bottom 21 of the enclosure 2. In accordance with the invention, no relative sealing function between the supply of the cold nitrogen and the recovery of the hot nitrogen needs to be produced for the platform 40. Thus, as emerges more clearly hereinbelow, no flexibility by metal bellows between the inlet 8 and outlet 9 conduits for the sodium is required.

The platform 40 can thus be open-work, notably to reduce the weight. When clearance is required for access to the bottom surfaces of the exchanger modules 3.1 to 3.8, openings of large dimension can be produced. Thus, by way of example, the platform 40 can be an assembly of beams produced by mechanized welding. The modules 3.1 to 3.8 are placed on the platform 40 and are held in position by virtue of angle irons fixed onto the platform 40 (FIG. 3).

Figure 4:
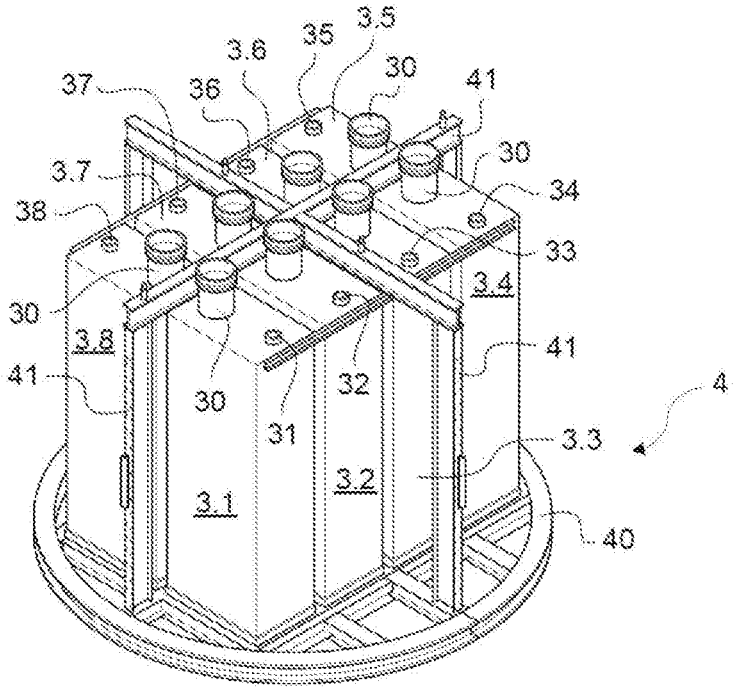
FIG. 4 is a perspective view of the plurality of exchanger modules and of an additional part of the support structure of the heat exchanger according to FIG. 2.

The support and holding structure 4 also comprises means 41 for laterally holding the exchanger modules 3.1 to 3.8, also fixed onto the platform 40 (FIG. 4). By way of example, the lateral holding means 41 can be an assembly of beams produced by mechanized welding which closely follows the outer form of the modules. It can be two groups of beams at 90° to one another and dividing the modules 3.1 to 3.8 into four equal groups (FIG. 4).

A sealing plate 42 is screwed onto the holding structure 41 (FIG. 5). Its function is to produce the seal between the cold nitrogen brought into the heat exchanger and the hot nitrogen leaving each exchanger module 3.1 to 3.8 is recovered by the first central manifold 6.

The first central manifold 6 or hot nitrogen manifold is fixed directly onto the sealing plate 42.

Figure 5A:
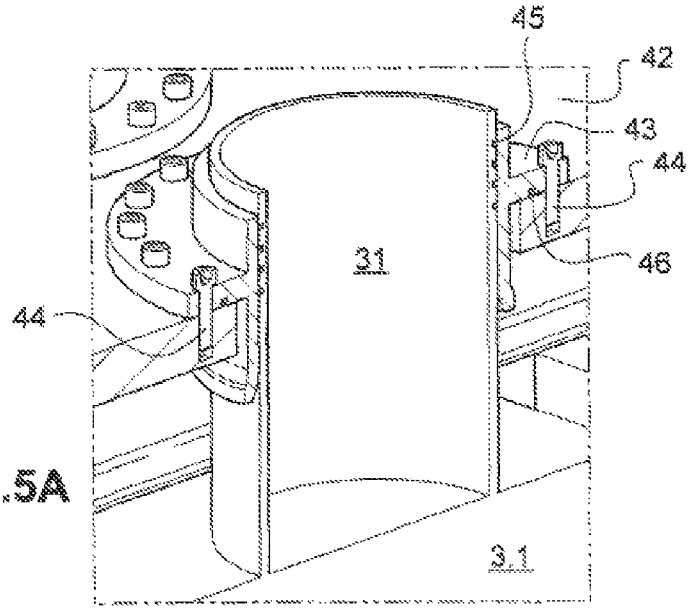
FIG. 5A is a detail view of FIG. 5.

An exemplary advantageous embodiment of the sliding sealing system between central manifold 6 and modules 3.1 to 3.8 is shown in FIG. 5A: a flange 43 is fixed onto the sealing plate 42 by means of screws 44 and segmented seals 45 between the outlet 30 of the modules and the manifold 6 are arranged. Seals 46 are also arranged between flange 43 and sealing plate 42. As a variant, metal bellows could be provided.

The operation of the heat exchanger 1 which has just been described will now be briefly explained in relation to the path of the nitrogen and of the sodium.

The cold nitrogen arrives, at a temperature of the order of 330° C. and a pressure of the order of 180 bar, through the inlet 10 and then is brought by the annular manifold 7 to the bottom of the enclosure 2 to the inlet chamber 5 above the bottom 21, as illustrated by the lateral arrows in FIG. 2.

The nitrogen then circulates through the heat exchanger modules 3.1 to 3.8 in which the heat originating from the hot sodium is transferred to it.

The nitrogen which has become hot, at a temperature of the order of 515° C., leaves the modules 3.1 to 3.8 and is then extracted from the enclosure by the outlet 11 via the first central manifold 6.

For its part, the hot sodium is brought, at a temperature of the order of 530° C., by the second central manifold 14 through the inlet 12 and is then distributed in each exchanger module 3.1 to 3.8 by the inlet conduits 81 to 88, as illustrated by the upward vertical arrows in FIG. 2.

The sodium then passes through the heat exchanger modules 3.1 to 3.8 in which it transfers its heat to the nitrogen.

The sodium which has become cold, at a temperature of the order of 345° C., leaves the modules 3.1 to 3.8 by their bottom ends and is then is extracted from the enclosure 2 by the outlet 13 via the outlet conduits 91 to 98.

Figure 2A:
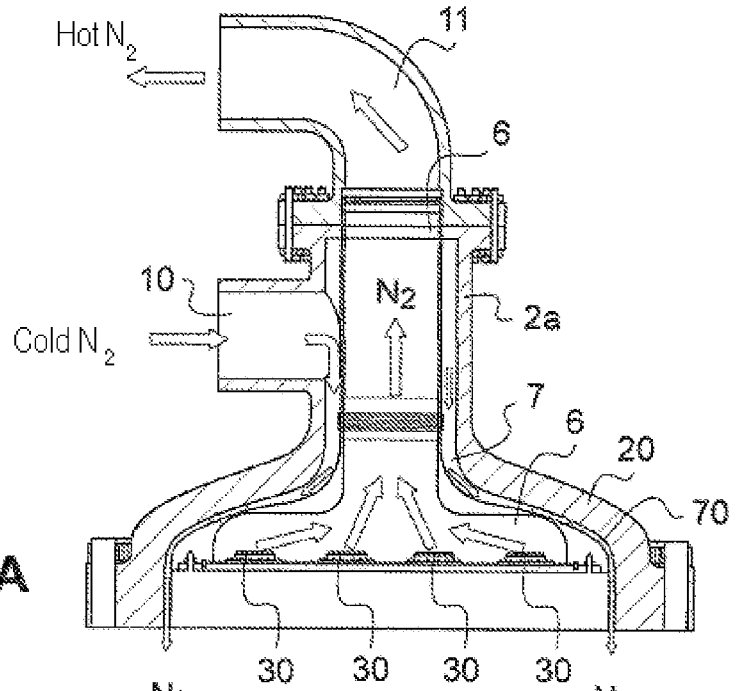
FIG. 2A is a perspective and cut-away view of the upper part of a heat exchanger according to FIG. 2.
Figure 2B:
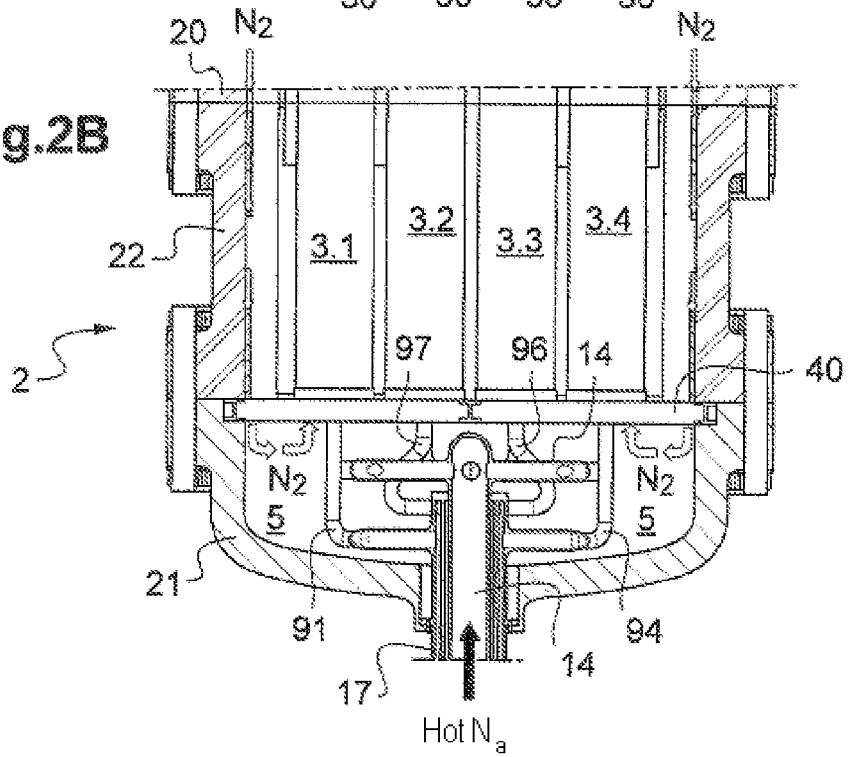
FIG. 2B is a perspective and cut-away view of the lower part of a heat exchanger according to FIG. 2.

In a heat exchanger 1 according to the invention, the cold gas (cold $N_2$) circulates from top to bottom and in counter-flow with the hot sodium. Thus, as better illustrated in FIGS. 2A and 2B, the cold gas (cold $N_2$) arrives in the chamber 5, enters in the bottom part of the modules 3.1 to 3.8 then leaves hot through the outlets 30 of the modules to feed the manifold 6 and finally leaves the exchanger by the outlet 11. As illustrated in FIG. 2A, in the heat exchanger 1 according to the invention, there is no gas inlet manifold for each module: the gas channels delimited between the deflector 7 and the enclosure 2 emerge directly into the latter, in the chamber 5. Thus, the chamber 5 defined by the enclosure 2 acts as gas inlet manifold.

The circulation of the fluids is compatible with a natural convection circulation.

In practice, a forced convection is provided for nominal operation, in other words to initiate the movement of the gas and of the liquid sodium in the exchanger 1. Then, in case of accident (stopping of the pumps for example), the circulation can continue by natural convection. Indeed, the cooling sodium tends to drop naturally and, when it is cooled in an exchanger module 3.1 to 3.8, its extraction is facilitated by gravity. Thus, the sodium that has become cold is discharged in the bottom part of the device which improves its gravity draining.

For its part, the cold gas ($N_2$) descends along the wall of the sealed enclosure 2 and it rises up again when it is reheated to be extracted by the central manifold 6. The heat favors its progression toward the top of the exchanger 1.

Other variants and enhancements can be provided without in any way departing from the scope of the invention.

REFERENCE CITED

[1]: "*Innovative power conversion system for the French SFR prototype, ASTRID*", L. Cachon and al. Proceeding of ICAPP'12, Chicago, USA, Jun. 24-28, 2012, Paper 12300.

The invention claimed is:

1. A heat exchanger exchanging heat between a first and a second fluid, comprising:

a sealed enclosure having a central axis (X) and comprising, at one of its longitudinal ends, at least one inlet and one outlet for the first fluid and, at the other of its longitudinal ends, at least one inlet and one outlet for the second fluid, the sealed enclosure being adapted to be pressurized, at least one heat exchanger module incorporating a first and a second fluid circuit, extending parallel to the central axis (X) and arranged inside the enclosure, a structure for supporting and holding the at least one heat exchanger module, rigidly fixed to the enclosure, the at least one heat exchanger module being supported and held exclusively by the structure for supporting and holding, an inlet or outlet chamber for the first fluid, formed axially between the structure for supporting and holding and the sealed enclosure, and communicating with one of the inlet and the outlet of the first fluid circuit, a first central manifold extending around the central axis (X), entirely arranged axially opposite the chamber and communicating, on the one hand, with one of the inlet and the outlet for the first fluid of the enclosure and, on the other hand, with the other of the inlet and the outlet of the first fluid circuit, an annular manifold arranged around the first central manifold and the at least one heat exchanger module and extending to at least to the structure for supporting and holding, forming a guiding space for the first fluid and communicating, on the one hand, with the other of the inlet and the outlet for the first fluid of the enclosure and, on the other hand, with the chamber, at least one inlet conduit communicating on the one hand with the inlet for the second fluid of the enclosure, and, on the other hand, with the inlet of the second fluid circuit, at least one outlet conduit communicating on the one hand with the outlet for the second fluid of the enclosure, and, on the other hand, with the outlet of the second fluid circuit, the conduits not being supported by the structure for supporting and holding.

2. The heat exchanger as claimed in claim 1, comprising:

a plurality of heat exchanger modules, each extending parallel to the central axis (X) and each arranged inside the outer enclosure, a plurality of inlet conduits each communicating on the one hand with the inlet for the second fluid of the enclosure, and on the other hand with the inlet of the second fluid circuit of one of the heat exchanger modules, a plurality of outlet conduits communicating on the one hand with the outlet for the second fluid of the enclosure, and on the other hand with the outlet of the second fluid circuit.

3. The heat exchanger as claimed in claim 2, the plurality of inlet conduits communicating with a second central manifold.

4. The heat exchanger as claimed in claim 2, the plurality of outlet conduits communicating with a third central manifold.

5. The heat exchanger as claimed in claim 2, a third central manifold being arranged coaxially around the second central manifold.

6. The heat exchanger as claimed in claim 1, the inlet of the first fluid circuit of each heat exchanger module being arranged at a longitudinal end of each heat exchanger module.

7. The heat exchanger as claimed in claim 1, the inlet of the second fluid circuit of each heat exchanger module being arranged at a longitudinal end of each heat exchanger module.

8. The heat exchanger as claimed in claim 1, the inlet of the first fluid circuit and the inlet of the second fluid circuit of each heat exchanger module being arranged at a longitudinal end of each heat exchanger module.

9. The heat exchanger as claimed in claim 1, the outlet of the first fluid circuit being arranged at a longitudinal end of each heat exchanger module.

10. The heat exchanger as claimed in claim 1, the outlet of the second fluid circuit being arranged at a longitudinal end of each heat exchanger module.

11. The heat exchanger as claimed in claim 1, the outlet of the first fluid circuit and the outlet of the second fluid circuit being arranged at a longitudinal end of each heat exchanger module.

12. The heat exchanger as claimed in claim 1, the inlet of the first fluid circuit and the outlet of the second fluid circuit of each heat exchanger module being arranged at a same longitudinal end and the inlet of the second fluid circuit and the outlet of the first fluid circuit of each heat exchanger module being arranged at a same opposite longitudinal end.

13. A method for operating the heat exchanger as claimed in claim 1, the sealed enclosure being arranged substantially vertically with the inlet and the outlet for the first fluid at the top and the inlet and the outlet for the second fluid at the bottom.

14. The use of the heat exchanger as claimed in claim 1, the first fluid, as secondary fluid, being a gas or a gas mixture, and the second fluid, as primary fluid, being a liquid metal.

15. The use of the assembly as claimed in claim 10, the first fluid primarily comprising nitrogen and the second fluid being liquid sodium.

16. The use of the assembly as claimed in claim 10, the first or the second fluid originating from a nuclear reactor.

17. A nuclear installation comprising a fast neutron nuclear reactor cooled with liquid metal and a heat exchanger claimed in claim 1.

* * * * *